US012607349B2

(12) United States Patent
Kreis et al.

(10) Patent No.: US 12,607,349 B2
(45) Date of Patent: Apr. 21, 2026

(54) DARK RADIATOR

(71) Applicant: Schwank GmbH, Cologne (DE)

(72) Inventors: Edgar Kreis, Freigericht (DE); Alexander Genzel, Bonn (DE); Torsten Stohler, Mettmann (DE); Thomas Renner, Wesseling (DE)

(73) Assignee: Schwank GmbH, Cologne (DE)

( * ) Notice: Subject to any disclaimer, the term of this patent is extended or adjusted under 35 U.S.C. 154(b) by 339 days.

(21) Appl. No.: 18/279,950

(22) PCT Filed: Dec. 6, 2022

(86) PCT No.: PCT/EP2022/084654
§ 371 (c)(1),
(2) Date: Sep. 1, 2023

(87) PCT Pub. No.: WO2023/104823
PCT Pub. Date: Jun. 15, 2023

(65) Prior Publication Data

US 2024/0142101 A1 May 2, 2024

(30) Foreign Application Priority Data

Dec. 10, 2021 (EP) ..... 21213778

(51) Int. Cl.
*F23D 14/12* (2006.01)

(52) U.S. Cl.
CPC ..... *F23D 14/12* (2013.01); *F23D 2203/002* (2013.01); *F23D 2203/007* (2013.01)

(58) Field of Classification Search
CPC ..... F23D 14/12; F23D 2203/002; F23D 2203/007
USPC ..... 431/328
See application file for complete search history.

(56) References Cited

U.S. PATENT DOCUMENTS

| | | | | |
|---|---|---|---|---|
| 5,271,729 | A | 12/1993 | Gensler et al. | |
| 2004/0115575 | A1 | 6/2004 | Kayahara et al. | |
| 2005/0247300 | A1 | 11/2005 | Collier | |
| 2005/0250062 | A1* | 11/2005 | Kornbluth | F23D 14/34 431/11 |
| 2009/0263753 | A1* | 10/2009 | Quinn | F23C 9/006 431/9 |
| 2012/0183914 | A1 | 7/2012 | Poe et al. | |
| 2013/0260323 | A1* | 10/2013 | Hong | F23N 5/00 431/14 |

(Continued)

FOREIGN PATENT DOCUMENTS

| | | |
|---|---|---|
| DE | 1 064 671 B | 9/1959 |
| DE | 92 07 435 U1 | 8/1992 |

(Continued)

OTHER PUBLICATIONS

International Search Report in PCT/EP2022/084654, mailed Mar. 1, 2023.

*Primary Examiner* — Avinash A Savani
(74) *Attorney, Agent, or Firm* — Collard & Roe, P.C.

(57) ABSTRACT

A dark radiator includes a burner, a fan and a radiant tube which is connected to an exhaust gas discharge line, wherein the burner is connected to a fuel gas supply, wherein the fan is designed to supply the burner with combustion air, wherein the burner is designed to output a flame into the radiant tube, wherein the fuel gas supply is connected to a hydrogen source.

11 Claims, 3 Drawing Sheets

(56) References Cited

U.S. PATENT DOCUMENTS

Figure 1:
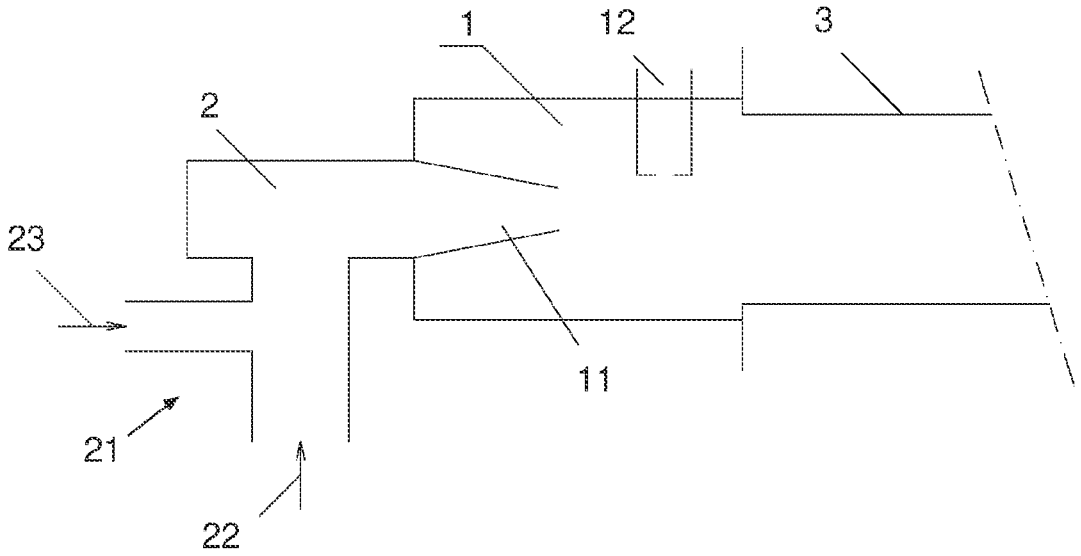

| | | | | |
|---|---|---|---|---|
| 2014/0076307 | A1 | 3/2014 | Boehm | |
| 2016/0334134 | A1* | 11/2016 | Russell | F23D 14/62 |
| 2018/0038588 | A1 | 2/2018 | Karkow et al. | |

FOREIGN PATENT DOCUMENTS

| | | | |
|---|---|---|---|
| DE | 10 2014 019 765 | A1 | 1/2016 |
| DE | 10 2014 019 766 | A1 | 8/2018 |
| EP | 2 708 814 | A1 | 3/2014 |

* cited by examiner

DARK RADIATOR

CROSS REFERENCE TO RELATED APPLICATIONS

This application is the National Stage of PCT/EP2022/084654 filed on Dec. 6, 2022, which claims priority under 35 U.S.C. § 119 of European Application No. 21213778.0 filed on Dec. 10, 2021, the disclosure of which is incorporated by reference. The international application under PCT article 21(2) was not published in English.

The invention relates to a dark radiator, having a burner, a fan, and a radiant tube, wherein the burner is connected to a fuel gas supply, wherein the fan is set up for supplying combustion air to the burner, wherein the burner is set up for outputting a flame into the radiant tube.

In the commercial and industrial sector, dark radiators are frequently used for heating production and warehousing sites. Dark radiators have one or more radiant tubes as radiating elements, to which at least one burner is assigned. By means of combustion of a mixture of fuel gas and air within the burner, a flame is generated, which can be distributed over the entire length of the radiant tube, using a fan. Natural gas or liquefied gas serves as the fuel gas, which is mixed in a predetermined ratio in a mixing chamber and afterward conducted into the combustion chamber by way of a jet and ignited. As a flashback barrier, the fuel gas/air mixture is passed through a grid or a mesh, which simultaneously has the task of holding the flame. The radiant tubes are regularly connected to be continuous and linear or U-shaped subsequent to the burner, and are supposed to emit the heat generated by the flame uniformly over the entire tube progression. The radiant tube is uniformly heated by the flame and generates a heat radiation that is emitted to a region to be heated. To increase the degree of effectiveness, reflectors are frequently used in this regard. The exhaust gases that result from combustion are removed from the radiant tube using the fan, for example they are conducted away to the outside air by way of exhaust gas tubes.

In order to minimize the harmful substances that are formed during combustion of the fuel, there is a constant effort to achieve an optimal stoichiometric ratio between fuel gas and air, so as to achieve the most complete combustion possible, during which the emission of harmful substances is minimized. For this purpose, it is proposed, for example in DE 10 2014 019 765 A1, to control the fan and the gas valve by means of a regulation device, so as to ensure complete combustion of the mixture of fuel gas and air. It is furthermore proposed in EP 2 708 814 A1 to equip the burner with a mixer and at least one secondary air channel, wherein the burner is set up so that part of the air supplied by the fan is passed to the mixer and another part of the air is passed to a secondary air channel, so as to supply part of the supplied combustion air to the flame without fuel. In DE 10 2014 019 766 A1, it is furthermore proposed to detect the current mixture ratio and/or the type of gas by way of a sensor, in particular with reference to the admixture of other types of gas, and to supply gas and/or air to the burner as a function of the result of a comparison of the measured and the required mixture ratio, until the necessary mixture ratio has been produced.

The above solutions have proven themselves in practice, and therefore dark radiators today have a relatively low emission of harmful substances with a simultaneously high degree of effectiveness. The present invention is based on the task of making available a dark radiator having a further reduced emission of harmful substances while keeping the degree of effectiveness at least the same. According to the invention, this task is accomplished by means of the characteristics of the characterizing part of claim 1.

With the invention, a dark radiator is made available that has a degree of effectiveness that at least remains the same in comparison with the state of the art, and in which the emission of harmful substances is reduced. Because of the fact that the fuel gas supply is preferably connected exclusively to a hydrogen source, theoretically no harmful substances containing carbon, such as carbon monoxide, carbon dioxide or hydrocarbons, are contained in the exhaust gas, since hydrogen does not contain any carbon.

In a further development of the invention, the fan is connected to an ejector having a suction connector connected to the hydrogen supply, wherein the combustion air drawn in by the fan serves as a driving medium, so that a hydrogen/combustion air mixture is supplied to the burner by the fan. As a result, feed of a hydrogen/combustion air mixture in a defined mixture ratio is made possible, and thereby setting of the flame temperature is achieved. By means of setting a high air number, in other words a high air excess, a reduction of the flame temperature can be achieved. Because of the great reactivity of hydrogen, a high air number of 2.5 to 3 is possible. In this way, the flame temperature can be brought to below the boundary temperatures of nitrogen oxide formation and of the materials of the radiant tube.

In a further embodiment of the invention, the burner comprises a gas jet and a mixing tube that is supplied with hydrogen by the gas jet, wherein the mixing tube is flushed with combustion air by the fan, wherein the gas jet, together with the mixing tube, forms an ejector, wherein the driving medium of the ejector is hydrogen introduced by means of the gas jet, and the medium drawn into the mixing tube is combustion air situated in the radiant tube, and wherein an ignition apparatus for igniting the hydrogen/combustion air mixture follows at a distance from the mixing tube in the flame direction. In this way, supply of a hydrogen/combustion air mixture is essentially made possible in a defined ratio. Because of the fact that mixing of the hydrogen with the combustion air takes place only in the mixing tube, outside of the fan, the demands on the fan material are reduced, since the risk of a flame flashback into the fan is no longer possible here. Preferably, a flashback barrier is arranged in the mixing tube, at its end directed in the flame direction. In this way, a flame flashback into the mixing tube is prevented.

In a further embodiment of the invention, the burner comprises a gas jet, wherein the fan is set up for flushing the gas jet with combustion air, and whereby no fuel gas mixing chamber is provided for pre-mixing fuel gas and combustion air, and the gas jet is supplied exclusively with fuel gas. In this way, a simple and cost-advantageous structure of the burner is achieved. Surprisingly it has been shown that due to the great reactivity of hydrogen, complete combustion of the hydrogen is achieved without pre-mixing with combustion air. In this regard, a great distance of the flame from the gas jet occurs up to the required pre-mixing of the hydrogen with the combustion air that flushes the fan, and thereby no thermal impairment of the gas jet occurs. Furthermore, it has been shown that the risk of a flame flashback also does not exist, and therefore the flame holder required in the state of the art, in the form of a perforated plate or a wire mesh, is not required.

In a further development of the invention, a combustion air mixing chamber is arranged to precede the burner in the flame direction, which chamber is connected to a combustion air source and to an exhaust gas discharge line. By means of supplying exhaust gases to the combustion air, a reduction in oxygen is achieved, and thereby it is made possible to lower the flame temperature. Furthermore, a reduction in nitrogen oxide emissions is brought about by the recirculation of the exhaust gas.

In a further development of the invention, the fan is arranged to precede the burner in the flame direction, and the combustion air mixing chamber is arranged within the fan. In this way, good mixing of combustion air and exhaust gas within the fan is achieved.

In an embodiment of the invention, the connection between the exhaust gas discharge line and the combustion air mixing chamber comprises a branching-off device by means of which the ratio of the branched-off exhaust gas volume stream to the combustion air volume stream is determined. In this way, setting of the oxygen content of the combustion air/exhaust gas mixture is made possible. Preferably the branching-off device comprises an adjustment device by means of which the ratio of the branched-off exhaust gas volume stream and the combustion air volume stream can be set.

In a further development of the invention, the burner serves as a primary burner that is followed by a secondary burner in the radiant tube, at a distance in the flame direction, the fuel gas supply of which secondary burner is connected with a hydrogen source as a fuel gas source, wherein the exhaust gas stream of the preceding primary burner is supplied to the secondary burner as combustion air. In this way, post-treatment of the exhaust gas of the primary burner is achieved, and thereby an emission of nitrogen oxides is minimized to a great extent. It has been shown that based on the great reactivity of hydrogen, the remaining oxygen content in the exhaust gas of the primary burner is easily sufficient for combustion of the hydrogen of the secondary burner. Furthermore, the combustion process in the secondary burner is promoted by means of the temperature of the exhaust gas stream of the primary burner.

In an embodiment of the invention, an equalization element in the form of a compensator for balancing out thermally caused length changes within the radiant tube is placed in line between the primary burner and the secondary burner. This compensator, which is preferably configured as an axial compensator, absorbs the movement of the radiant tube along the axis, and thereby damage to the radiant tube is prevented.

Figure 2:
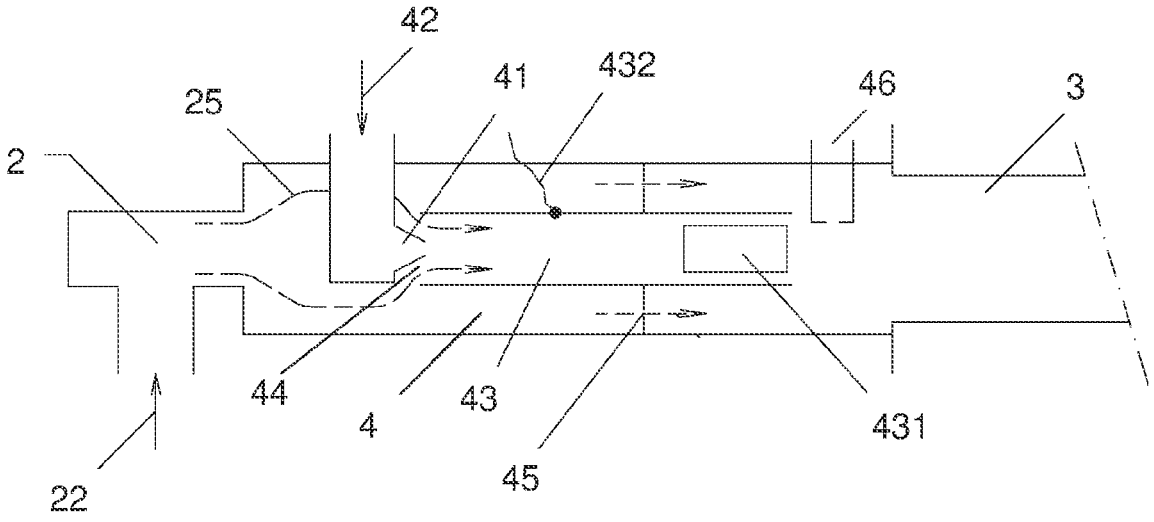
Figure 3:
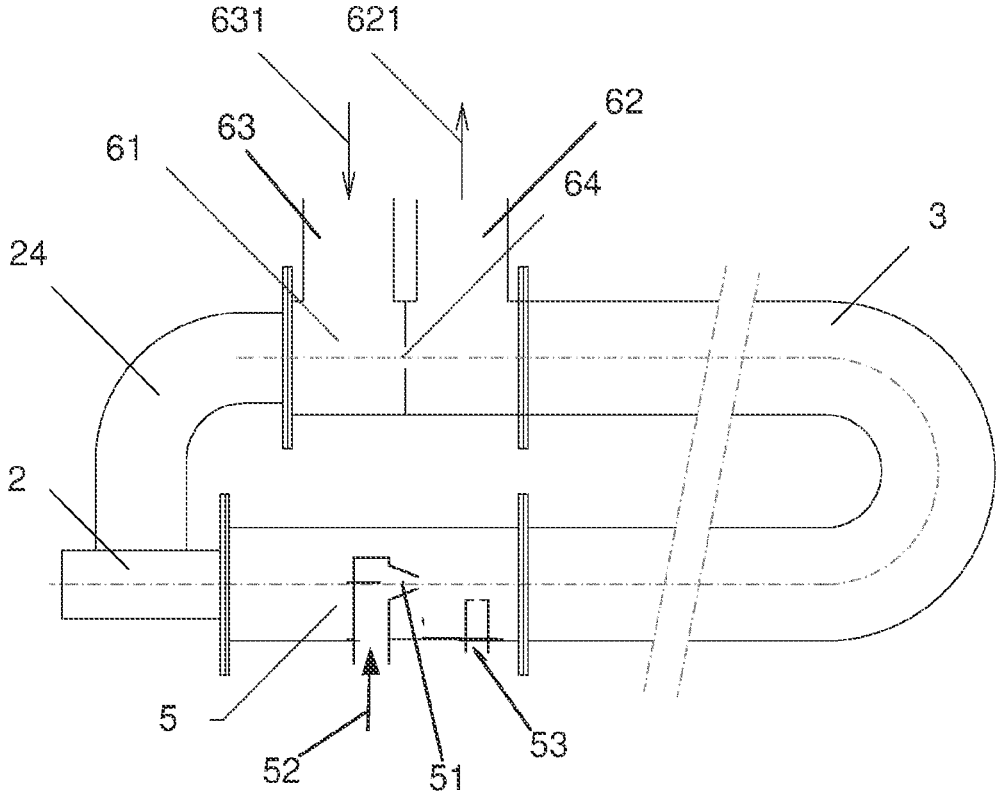
Figure 4:
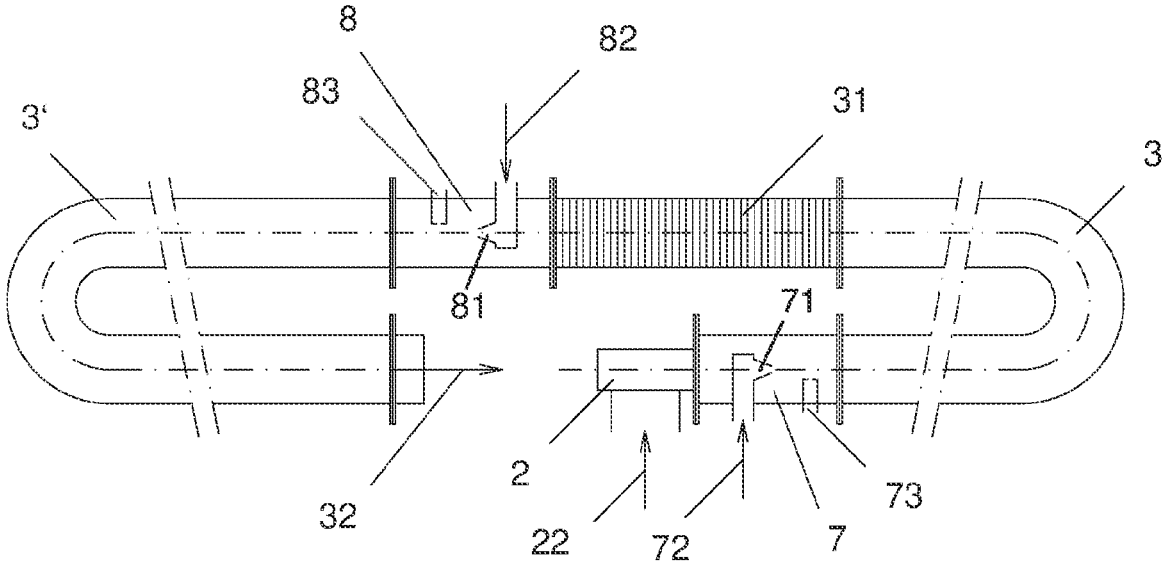
Figure 5:
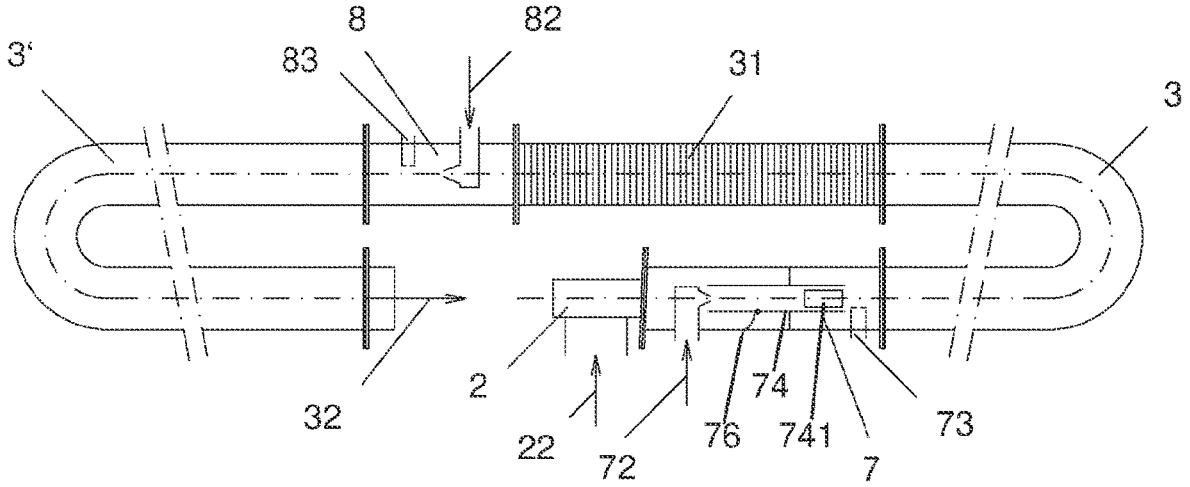

Other further developments and embodiments of the invention are indicated in the remaining dependent claims. Exemplary embodiments of the invention are shown in the drawings and will be described in detail below. The figures show:

FIG. 1 the schematic representation of a dark radiator;

FIG. 2 the schematic representation of a dark radiator in a further embodiment;

FIG. 3 the schematic representation of a dark radiator in a third embodiment;

FIG. 4 the schematic representation of a dark radiator in a fourth embodiment, with a primary and secondary burner;

FIG. 5 the schematic representation of a dark radiator in a further embodiment, with a primary and secondary burner.

The dark radiator according to FIG. 1, selected as an exemplary embodiment, comprises a burner 1 that is connected to a fan 2 and followed by a radiant tube 3. The radiant tube 3 is merely indicated in FIG. 1; the radiant tube 3 can certainly extend over several meters in length and be formed from multiple radiant tube elements. In the exemplary embodiment, the radiant tube 3 is formed as a highly heat-resistant stainless steel tube. Alternatively, special steels having a thermally applied aluminum oxide layer can also be used. In the exemplary embodiment, the radiant tube 3 is enclosed by a reflector—not shown—which is formed, in the exemplary embodiment, from surface-structured sheet aluminum and has bulkhead plates on both sides, to reduce convective losses.

The burner 1 comprises a gas jet 11 that serves as a gas/air mixture jet and is provided, in the exemplary embodiment, with a flashback barrier, and is connected to the fan 2. At a distance from the gas jet 11, an ignition electrode 12 is arranged in the burner 1. The fan 2 is connected to an ejector 21 on its suction side, the drive connector of which ejector is connected to a combustion air supply 22 and the suction connector of which ejector is connected with a hydrogen supply 23. Here, the combustion air drawn in by the fan 2 serves as a driving medium, which is brought about by means of drawing in the hydrogen. On the pressure side, a hydrogen/combustion air mixture is supplied to the gas jet 11 by the fan 2 in this way, which mixture is ignited after it exits through the gas jet 11, by means of the ignition electrode 12, and thereby a flame that extends through the radiant tube 3 is generated.

In the exemplary embodiment according to FIG. 2, a burner 4 is provided, which in turn is connected with a fan 2 and followed by a radiant tube 3. The burner 4 comprises a hydrogen jet 41 that is connected to a hydrogen supply 42 and which in turn is oriented in line with the longitudinal center axis of the radiant tube 3. Here, a gas jet that exclusively has hydrogen applied to it is referred to as a hydrogen jet. The hydrogen jet projects into a mixing tube 43 that runs coaxially to the radiant tube 3, wherein a radial suction gap of an ejector formed by the hydrogen jet 41 and the mixing tube 43 is formed between mixing tube 43 and hydrogen jet 41. The mixing tube 43 is held in the burner 4 by way of a separating shutter 45 provided with flushing openings, which shutter encloses the tube. On its end that lies opposite the hydrogen jet 41, a flashback barrier 431 is arranged in the mixing tube 43. Furthermore, a thermosensor 432 for detecting a possible flame flashback is arranged in the mixing tube 43.

The fan 2 is oriented in such a manner that it flushes the hydrogen jet 41 and the mixing tube 43 with combustion air 35. By means of the hydrogen stream introduced into the mixing tube 43 by way of the hydrogen jet 41, combustion air 35 is drawn in by way of the suction gap 44, which air mixes with the hydrogen. The hydrogen/combustion air mixture exiting from the mixing tube 43 is ignited by means of the ignition electrode 46 arranged at a distance from the mixing tube 43, and thereby a flame is formed, which extends into the radiant tube 3 over its length.

A part of the combustion air 35 blown into the burner 1 by the fan 2 flows through the flushing openings of the separating walls 45 and flushes the flame that extends into the radiant tube 3, which flame is thereby cooled. The ejector formed by the hydrogen jet 41 and the mixing tube 43 is configured in such a manner that combustion air having an air number of 2.5 is supplied to the hydrogen, and thereby a temperature of about 900° C. is achieved.

In the exemplary embodiment according to FIG. 3, the dark radiator comprises a burner 5 that is connected to a fan 2 and followed by a radiant tube 3. The radiant tube 3 has a U-shaped progression, followed by a branching tube 6 that is connected to the fan 2 by way of a suction tube 24. The burner 5 in turn comprises a hydrogen jet 51 that is connected to a hydrogen supply 52. The hydrogen jet 51 is oriented in the direction of the center longitudinal axis of the radiant tube 3. An ignition electrode 53 for igniting the hydrogen is positioned at a distance from the hydrogen jet 51.

The ejector tube 6 comprises a main tube piece 61 by way of which the radiant tube 3 is connected with the suction tube 24. An exhaust gas discharge tube 62 branches off from the main tube piece 61 and, at a distance from the latter, a combustion air supply tube 63 branches off. A recirculation shutter 64 is arranged in the main tube piece 61, between the exhaust gas supply tube 62 and the combustion air supply tube 63. The combustion air stream 631 drawn in by the fan 2, by way of the suction tube 24, serves as the driving medium of the ejector tube 6, by way of which a part of the exhaust gas stream 621 is drawn in by means of the recirculation shutter 64. The exhaust gas/combustion air mixture produced in this manner is introduced into the burner 5 by means of the fan 2, where it flushes the hydrogen jet 51. The proportion of the exhaust gas stream in the combustion air stream can be adjusted by means of the recirculation shutter 64, and thereby, in turn, the oxygen content of the exhaust gas/combustion air stream mixture that flushes the hydrogen jet 51 is determined. The main exhaust gas stream is conducted away by way of the exhaust gas discharge tube 62.

The burner 5, the radiant tube 3, the ejector tube 6, and the fan 2 connected to the suction tube 24 are connected to one another, in each instance, by way of flange connections.

In the exemplary embodiment according to FIG. 4, two burners are arranged in the radiant tube 3, a primary burner 7 and a secondary burner 8 which follows the former in the flame direction. The primary burner 7 and the secondary burner 8 correspond to the burner 5 explained in the exemplary embodiment described above. These in turn comprise a hydrogen jet 71, 81, which is connected to a hydrogen supply 72, 82, wherein an ignition electrode 73, 83 is positioned at a distance from the hydrogen jet 71, 81. The primary burner 7 is connected to a fan 2, the suction connector of which is connected to a combustion air supply 22. The primary burner 7 is followed by a radiant tube 3 that is configured in U shape and connected with the secondary burner 8 by way of an equalization element 31. In turn, a further radiant tube 3' follows the secondary burner 8, which tube is once again configured in U shape in the exemplary embodiment.

The hydrogen jet 71 of the primary burner 7 is flushed with combustion air by the fan 2. The hydrogen/combustion air mixture that forms ahead of the hydrogen jet 71 is ignited by the ignition electrode 73, and thereby a first flame forms at a distance ahead of the hydrogen jet 71. The exhaust gas stream of this first flame flows through the equalization element 32 and flushes the hydrogen jet 81 of the secondary burner 8. The exhaust gas stream/hydrogen mixture that forms ahead of the hydrogen jet 81 has a sufficiently high oxygen content so that it can be ignited by the ignition electrode 83, and thereby a second flame is formed, which extends along the second radiant tube 3'. The exhaust gas stream of this second flame is conducted away out of the second radiant tube 3'. The equalization element 31 positioned in the section of the radiant tube 3 exposed to a high temperature gradient by means of the secondary burner 8 serves for equalization of thermally caused length changes within the radiant tube. This element is configured as an axial compensator in the exemplary embodiment, which absorbs the movements of the pipeline along the axis.

In this exemplary embodiment, combustion air is supplied to the primary burner 7 by way of the fan 2, which air flushes the hydrogen jet 71 of the primary burner 7. In a modified embodiment, the fan 2, which precedes the primary burner 7, can also be connected to an ejector, in accordance with the first exemplary embodiment, wherein the combustion air drawn in serves as a driving medium, by way of which combustion air is drawn in from the second radiant tube 3'. In a further modified embodiment, the second radiant tube 3' can also be connected to the suction line of the fan 2 by way of an ejector tube, as described in the third exemplary embodiment. In this manner, the flame temperature of the first flame of the primary burner 7 can also be adjusted. Furthermore, in this way a further reduction of the nitrogen oxide content of the exhaust gas that is conducted away is also made possible.

In the exemplary embodiment according to FIG. 5, the primary burner 7' is configured in accordance with the burner of the exemplary embodiment according to FIG. 2, wherein the hydrogen jet 71 in turn projects into a mixing tube 74, so that a suction gap 75 is formed between hydrogen jet 71 and mixing tube 74. On its end that lies opposite the hydrogen jet 71, a flashback barrier 741 is once again arranged in the mixing tube 74. For the remainder, the structure of the dark radiator of this exemplary embodiment corresponds to the exemplary embodiment according to FIG. 4, wherein in this exemplary embodiment, as well, the embodiments listed there for mixing part of the exhaust gas stream of the second radiant tube 3' into the combustion air drawn in by the fan 2 are possible.

The invention claimed is:

1. A dark radiator, having a burner, a fan, and a radiant tube, which is connected to an exhaust gas discharge line,
- wherein the burner is connected to a fuel gas supply,
- wherein the fan is set up for supplying combustion air to the burner,
- wherein the burner is set up for outputting a flame into the radiant tube,
- wherein the fuel gas supply is connected to a hydrogen source,
- wherein the burner comprises a gas jet and a mixing tube,
- wherein the mixing tube is supplied with hydrogen by the gas jet,
- wherein the mixing tube is flushed with combustion air by the fan,
- wherein the gas jet, together with the mixing tube, forms an ejector,
- wherein the driving medium of the ejector is hydrogen introduced by the gas jet, and the medium drawn into the mixing tube is combustion air situated in the radiant tube,
- wherein an ignition apparatus for igniting the hydrogen/combustion air mixture follows at a distance from the mixing tube in the flame direction, and
- wherein a flashback barrier is arranged in the mixing tube, at an end of the mixing tube directed in the flame direction.

2. A dark radiator, having a burner, a fan, and a radiant tube, which is connected to an exhaust gas discharge line,
- wherein the burner is connected to a fuel gas supply,
- wherein the fan is set up for supplying combustion air to the burner,
- wherein the burner is set up for outputting a flame into the radiant tube,
- wherein the burner comprises a gas jet,
- wherein the fan is set up for flushing the gas jet with combustion air,
- wherein no fuel gas mixing chamber is provided for pre-mixing fuel gas and combustion air, and the gas jet is supplied exclusively with fuel gas, wherein a combustion air mixing chamber is arranged to precede the burner in the flame direction, wherein the combustion air mixing chamber is connected to a combustion air source and to the exhaust gas discharge line, and wherein the connection between the exhaust gas discharge line and the combustion air mixing chamber comprises a branching-off device by which the ratio of the branched-off exhaust gas volume stream and the combustion air volume stream is determined.

3. The dark radiator according to claim 2, wherein the fan is arranged to precede the burner in the flame direction, and the combustion air mixing chamber is arranged within the fan.

4. A dark radiator, having a burner, a fan, and a radiant tube, which is connected to an exhaust gas discharge line, wherein the burner is connected to a fuel gas supply, wherein the fan is set up for supplying combustion air to the burner, wherein the burner is set up for outputting a flame into the radiant tube, wherein the burner comprises a gas jet and a mixing tube, wherein the mixing tube is supplied with hydrogen by the gas jet, wherein the mixing tube is flushed with combustion air by the fan, wherein the gas jet, together with the mixing tube, forms an ejector, wherein the driving medium of the ejector is hydrogen introduced by the gas jet, and the medium drawn into the mixing tube is combustion air situated in the radiant tube, wherein an ignition apparatus for igniting the hydrogen/combustion air mixture follows at a distance from the mixing tube in the flame direction, wherein a combustion air mixing chamber is arranged to precede the burner in the flame direction, wherein the combustion air mixing chamber is connected to a combustion air source and to the exhaust gas discharge line, and wherein the connection between the exhaust gas discharge line (62) and the combustion air mixing chamber comprises a branching-off device by which the ratio of the branched-off exhaust gas volume stream and the combustion air volume stream is determined.

5. The dark radiator according to claim 4, wherein the branching-off device comprises an adjustment device by which the ratio of the exhaust gas volume stream and the combustion air volume stream can be set.

6. The dark radiator according to claim 2, wherein the burner serves as a primary burner that is followed by a secondary burner in the radiant tube, at a distance in the flame direction, the fuel gas supply of which secondary burner is connected to a hydrogen source as a fuel gas source, wherein the exhaust gas stream of the preceding primary burner is supplied to the secondary burner as combustion air.

7. The dark radiator according to claim 6, wherein an equalization element for balancing out thermally caused length changes within the radiant tube is placed in line between the primary burner and the secondary burner.

8. The dark radiator according to claim 4, wherein the fan is arranged to precede the burner in the flame direction, and the combustion air mixing chamber is arranged within the fan.

9. The dark radiator according to claim 2, wherein the branching-off device comprises an adjustment device by which the ratio of the exhaust gas volume stream and the combustion air volume stream can be set.

10. The dark radiator according to claim 4, wherein the burner serves as a primary burner that is followed by a secondary burner in the radiant tube, at a distance in the flame direction, the fuel gas supply of which secondary burner is connected to a hydrogen source as a fuel gas source, wherein the exhaust gas stream of the preceding primary burner is supplied to the secondary burner as combustion air.

11. The dark radiator according to claim 10, wherein an equalization element for balancing out thermally caused length changes within the radiant tube is placed in line between the primary burner and the secondary burner.

* * * * *